United States Patent [19]

Saito

[11] Patent Number: 4,750,244

[45] Date of Patent: Jun. 14, 1988

[54] ACTUATOR-EQUIPPED BUCKLE

[75] Inventor: Hiroyuki Saito, Chigasaki, Japan

[73] Assignee: Nippon Seiko Kabushiki Kaisha, Tokyo, Japan

[21] Appl. No.: 22,825

[22] Filed: Mar. 6, 1987

[30] Foreign Application Priority Data

Mar. 10, 1986 [JP] Japan ..... 61-33247[U]

[51] Int. Cl.[4] ..... A44B 11/25

[52] U.S. Cl. ..... 24/637; 24/641; 24/650

[58] Field of Search ..... 24/630, 633, 637, 639, 24/641, 642, 650; 297/648; 280/804

[56] References Cited

U.S. PATENT DOCUMENTS

| | | | |
|---|---|---|---|
| 256,087 | 4/1882 | Harness | 24/650 |
| 2,694,244 | 11/1954 | Nolan | 24/650 |
| 3,579,750 | 5/1971 | Carbon | 24/650 |
| 3,597,811 | 8/1971 | Cunaingham . | |
| 3,871,090 | 3/1975 | Romanzi, Jr. et al. | 24/641 |
| 4,126,919 | 11/1978 | Lassche | 24/637 |
| 4,225,155 | 9/1980 | Seiffert et al. | 280/804 |
| 4,380,751 | 4/1983 | Takada | 340/52 E |
| 4,490,892 | 1/1985 | Ueda | 24/641 |
| 4,589,172 | 5/1986 | Hoenigs et al. | 24/639 |
| 4,625,371 | 12/1986 | Ueda | 24/641 |
| 4,663,808 | 5/1987 | Kawai | 24/641 |

FOREIGN PATENT DOCUMENTS

| | | | |
|---|---|---|---|
| 3302723 | 8/1984 | Fed. Rep. of Germany | 24/633 |

*Primary Examiner*—Victor N. Sakran

*Attorney, Agent, or Firm*—Wegner & Bretschneider

[57] ABSTRACT

A buckle is constructed of a tongue, a base, a latch means capable of selectively taking either a latching state, in which the tongue is connectable to the base, or a non-latching state in which the tongue is released from the base, an operation means for bringing the latch means from the latching state to the non-latching state, a casing defining at least tongue-inserting opening and operation-means operating opening, and an actuator means capable of taking a first state while the tongue is connected to the base by the latch means in its latching state or a second state while the tongue is released from the base. A smaller part of said actuator means is exposed outside the casing in the first state than in the second state.

11 Claims, 8 Drawing Sheets

(a)

(b)

ACTUATOR-EQUIPPED BUCKLE

BACKGROUND OF THE INVENTION (1) Field of the Invention

This invention relates to a buckle equipped with an actuator which triggers a peripheral device, for example, a warning switch.

(2) Description of the Prior Art

As actuator-equipped buckles, the following buckle has heretofore been known as a typical example. Namely, it is an emergency release buckle (hereinafter abbreviated as "ERB" for the sake of brevity) which is incorporated in an automatic seat belt assembly and is selectively displaceable along a rail between an occupant-releasing position and an occupant-restraining position. Upon removal of an associated tongue, which carries an associated webbing, from a main part of the ERB, an actuator which has projected from the main part of the ERB before the removal of the tongue retreats within the main part of the ERB. If the ERB is at the occupant-restraining position, the actuator is caused to separate from a belt-wearing warning switch provided on the side of a main body of an associated vehicle so as to sound an alarm. When the tongue is inserted into the main part of the ERB on the other hand, the actuator is caused to project out and to press the switch so that the alarm is stopped.

In an ERB such as that described above, it is a normal state that the tongue is in the state inserted within the main part of the ERB and it is occasional that the tongue is released and the warning device itself is hence triggered. The actuator is however in a position projected out of the main part of the ERB in the normal state and is hence brought into contact with the switch whenever the ERB assumes the occupantrestraining position. The switch is therefore required to have good durability. Further, the actuator is left exposed out of the ERB in the normal state. This is certainly undesirable from the viewpoints of both safety and outward appearance.

SUMMARY OF THE INVENTION

An object of this invention is therefore to provide a buckle having such a structure that in order to solve the above-mentioned problem, the actuator is exposed out from the main part of the buckle only when the tongue is released.

In one aspect of this invention, there is thus provided a buckle, which comprises:

a tongue;

a base;

a latch means capable of selectively taking either a latching state, in which the tongue is connectable to the base, or a non-latching state in which the tongue is released from the base;

an operation means for bringing the latch means from the latching state to the non-latching state;

a casing defining at least tongue-inserting opening and operation-means operating opening; and an actuator means capable of taking a first state while the tongue is connected to the base by the latch means in its latching state or a second state while the tongue is released from the base, a smaller part of said actuator means being exposed outside the casing in the first state than in the second state.

In another aspect of this invention, there is also provided a buckle, which comprises:

a tongue;

a base;

a latch means supported on the base and being capable of selectively taking either a latching state, in which the tongue is connectable to the base, or a non-latching state in which the tongue is released from the base;

an operation means for bringing the latch means from the latching state to the non-latching state;

a casing defining at least tongue-inserting opening and operation-means operating opening; and an actuator means connected to the latch means and being capable of taking a first position in correspondence with the latching state of the latch means and a second position in correspondence with the non-latching state of the latch means, a smaller part of said actuator means being exposed outside the casing at the first position than at the second position.

In a further aspect of this invention, there is also provided a buckle, which comprises:

a tongue;

a base;

a latch means supported on the base and being capable of selectively taking either a latching state, in which the tongue is connectable to the base, or a non-latching state in which the tongue is released from the base;

an operation means for bringing the latch means from the latching state to the non-latching state;

a casing defining at least tongue-inserting opening and operation-means operating opening; and an actuator means capable of taking a first state upon insertion of the tongue into the base so as to allow the latch means to take the latching state or a second state upon ejection of the tongue from the base so as to hold the latch means in the non-latching state, a smaller part of said actuator means being exposed outside the casing at the first state than at the second state.

According to the present invention, the actuator is constructed to project out only when the tongue is in its released position. Durability is hence not required too much for an associated peripheral device such as switch and a buckle having good outward appearance is hence materialized.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENTS

Figure 1:
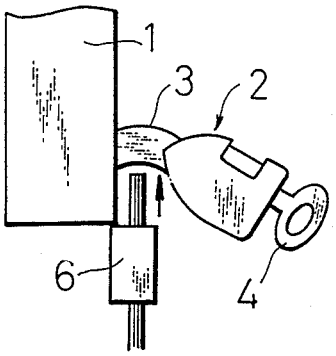
FIGS. 1(*a*) and 1(*b*) are schematic illustrations of an ERB and its associated peripheral elements.
Figure 1:
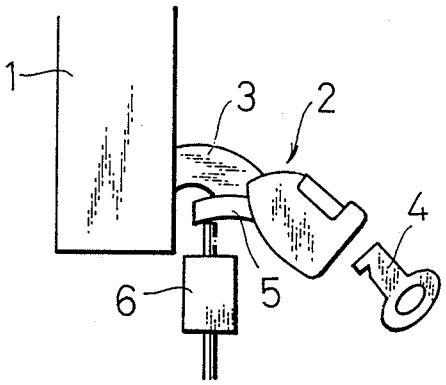

FIGS. 1(*a*) and 1(*b*) shows an ERB 2 which is guided along a rail 1 in an automatic seat belt system. In FIGS. 1(*a*) and 1(*b*), the ERB 2 provided as a unitary member with a slide anchor 3 is at an occupant-restraining position. In FIG. 1(*a*), a tongue 4 is in an inserted state, and an actuator 5 [see FIG. 1(*b*)]is in a retreated position and is in a state not engaged with a belt-wearing warning switch 6. In FIG. 1(*b*), the tongue 4 has been released and the actuator 5 is in a projected position so that the actuator 5 is in engagement with the switch 6, thereby sounding an alarm.

The first embodiment of the ERB 2 is depicted in FIGS. 2 through 5.

Figure 2:
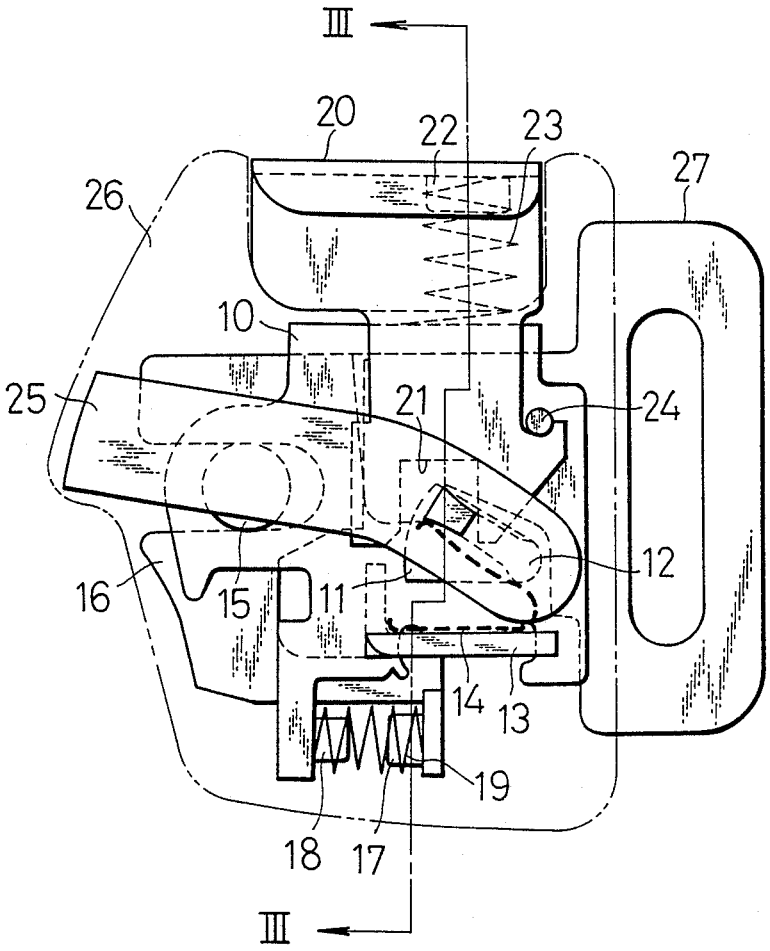
FIG. 2 is a front view of a buckle according to the first embodiment of this invention.

Sectorial slots 11,11 are formed in a face-to-face relation through both pendant walls of a base 10 which has a U-like cross-section. A latch piece 12 is inserted as a latch means rockably in the sectorial slots 11,11. The latch piece 12 can take either a latching state, in which the latch piece 12 has been swung upwards as shown in FIG. 2, or a non-latching state in which the latch piece 12 has been swung downwards. Between a bridge 13 provided fixedly on the base and the latch piece 12, there is provided a latch spring 14 so that the latch piece 12 is normally biased toward the latching state.

A pin 15 is also provided fixedly on the base 10. A slider 16 is provided, as a movable means, movably in the horizontal direction as viewed in FIGURE 2 while being guided by the pin 15. The slider 16 is biased rightwards as viewed in FIG. 2 by means of a push-out spring 19 provided between a projection 17 of the slider 16 and a projection 18 of the base 10.

Astride the base 10, a button 20 is provided as an operation means. When the button 20 is manually depressed downwards as viewed in FIG. 2, an acting edge 21 of the button 20 is caused to act on the latch piece 12 so that the latch piece 12 is brought into the non-latching state against the biasing force of the latch spring 14. Owing to the provision of a button spring 23 provided between a projection 22 of the button 20 and an arched top portion of the base 10, the button 20 is biased normally in the upward direction as viewed in FIG. 2. The upward movement of the button 20 is limited by a stopper 24 secured fixedly on the base 10.

An elongated actuator 25 is provided as a unitary member on the latch piece 12.

A casing 26 is provided covering the above-described elements of structure except for a manually-operated portion of the button 20. Through the cover 26, there are formed an opening through which a tongue 27 is inserted and another opening through which the actuator is allowed to project out.

The operation of the first embodiment having the above-described structure will next be described.

Figure 3:
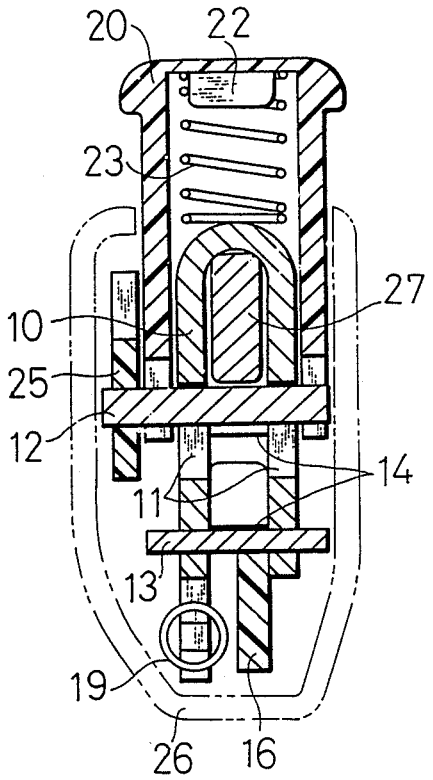
FIG. 3 is a cross-sectional view of the buckle of the first embodiment taken along line III—III of FIG. 2.

FIG. 2 and FIG. 3, which is a cross-sectional view taken along line III—III of FIG. 2, show the tongue 27 connected to the base 10 by way of the latch piece 12 in its latching state. In this connected state, the actuator 25 is at a first position where the actuator 25 is received in its entirety within the casing 26. Furthermore, the slider 16 has been pushed by a leading edge portion of the tongue 27 against the biasing force of the spring 19 and assumes a position retreated leftwards as viewed in FIG. 2.

Figure 4:
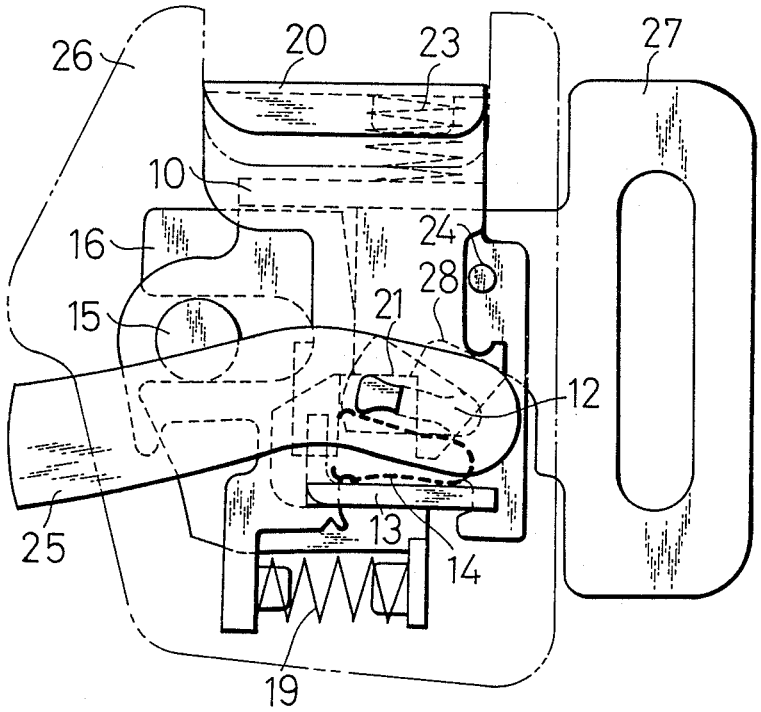
FIGS. 4 and 5 show the operation of the buckle of the first embodiment.

Let's now assume that the button 20 is depressed to release the tongue 27. The acting edge 21 of the button 20 begins to act on the latch piece 12 as depicted in FIG. 4 and starts shifting the latch piece 12 against the biasing force of the spring 14 toward the non-latching state. As a consequence, the latch piece 12 is released from a notch 28 of the tongue 27 and at the same time, the slider 16 is caused to advance by the force of the spring 19 to eject the tongue 27. At this time, the actuator 25 is also swung together with the latch piece 12 so that a left end portion of the actuator 25 projects out from the casing 26 as depicted in FIG. 4.

Figure 5:
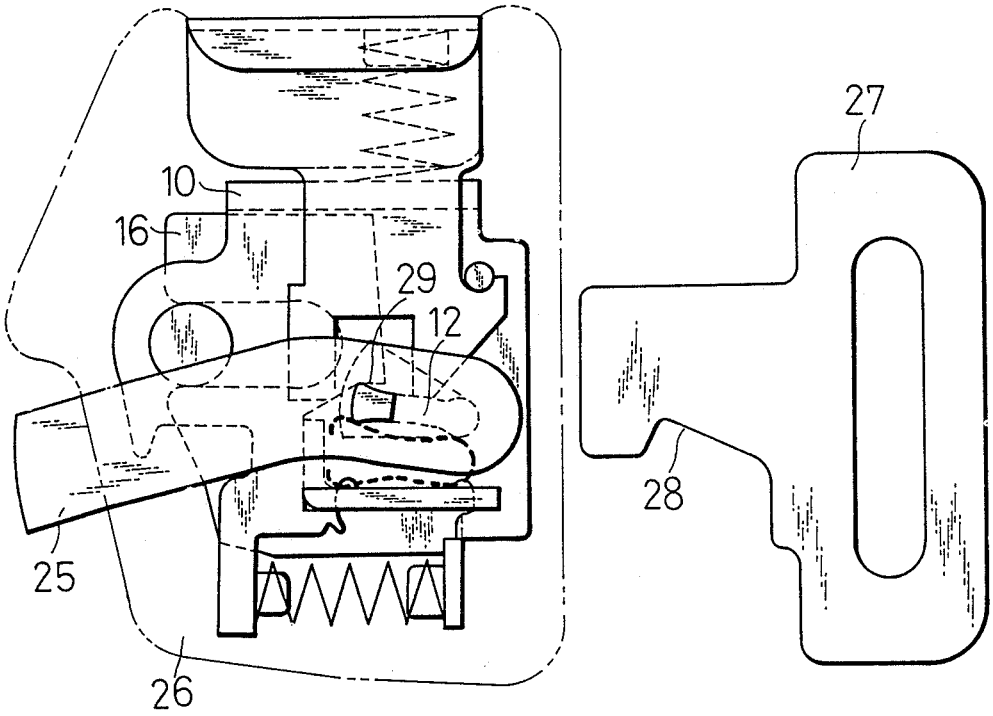

When the latch piece 12 has been shifted sufficiently toward the non-latching state by the button 20, the slider 16 moves fully to the advanced position as illustrated in FIG. 5 to hold down at an acting edge 29 thereof the latch piece 12 in the non-latching state. In the course of this operation, the actuator 25 begins to act on the belt-wearing warning switch 16. As soon as the latch piece 12 has assumed its position shown in FIG. 5, an alarm device (not shown) begins to sound an alarm.

In the connected state depicted in FIGS. 2 and 3, the force of the latch spring 14 is transmitted to the actuator 25 via the latch piece 12 so as to hold the actuator 25 at the first position. in the stage illustrated in FIG. 4, the force applied to the button 20 is transmitted further to the latch piece 12 so as to shift the actuator 25 from the first position. In the released state shown in FIG. 5, the actuator 25 is supported by the base 10 via the latch piece 12 and slider 16, whereby the actuator 25 is maintained at the second position exposed outside the casing 26.

Figure 6:
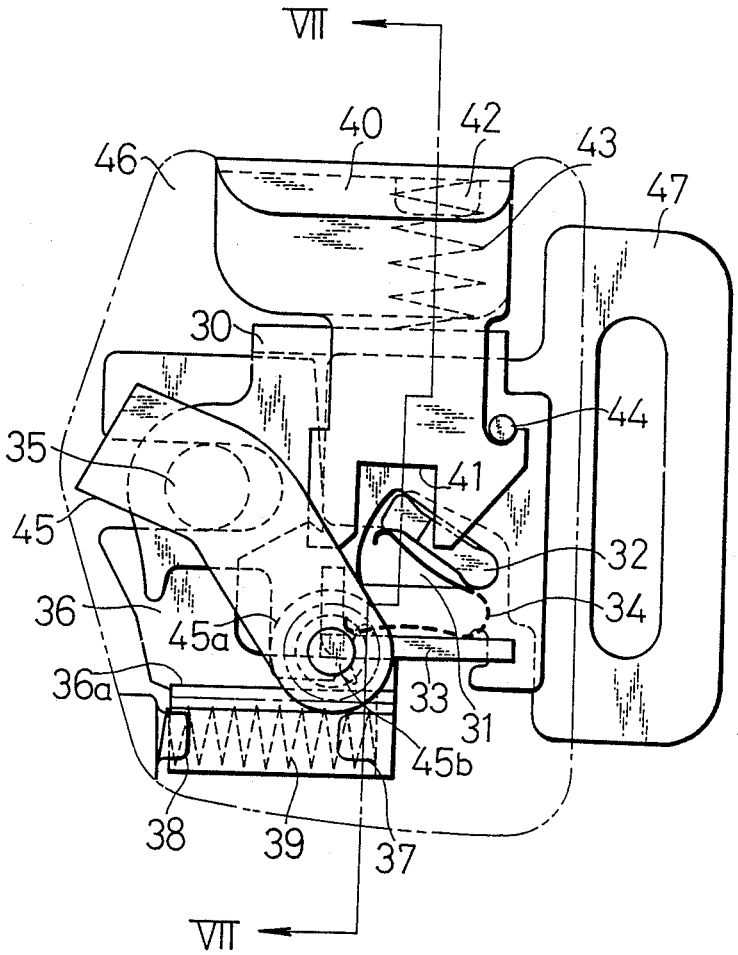
FIG. 6 is a front view of a buckle according to the second embodiment of this invention.
Figure 7:
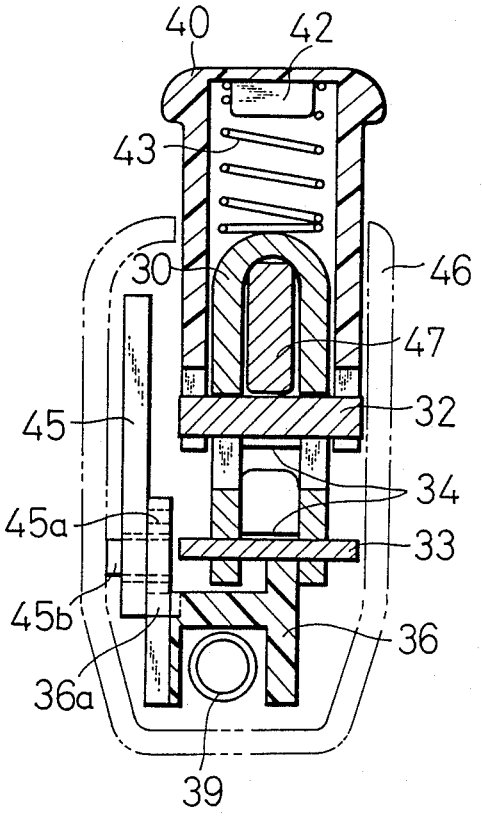
FIG. 7 is a cross-sectional view of the buckle taken along line VII—VII of FIG. 6.
Figure 8:
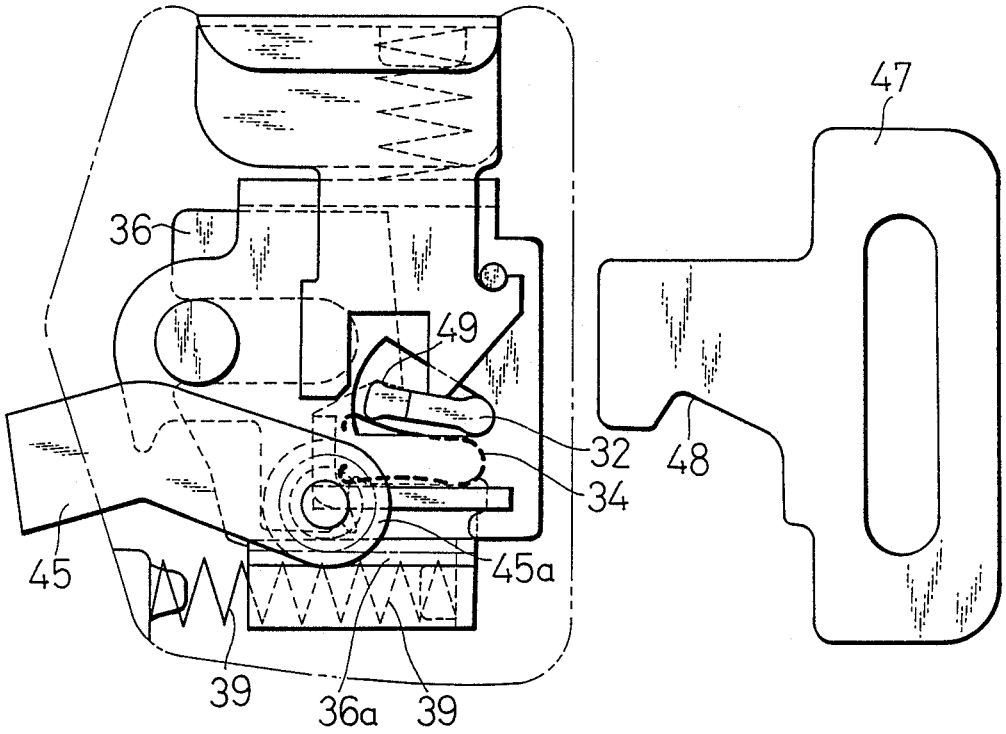
FIG. 8 illustrates the operation of the buckle of the second embodiment.

Referring next to FIGS. 6–8, the second embodiment of this invention will hereinafter be described.

In the second embodiment, a base 30, sectorial slots 31,31, a latch piece 32, a bridge 33, a latch spring 34, a pin 35, a button 40, an acting edge 41, a projection 42, a button spring 43, a stopper 44, a casing 46, a tongue 47 and a notch 48 are substantially the same as their corresponding elements of structure in the first embodiment.

The second embodiment is different from the first embodiment in that the actuator 45 is not provided as a unitary member with the latch piece 32 and instead, a pinion portion 45*a* of the actuator 45 is maintained in meshing engagement with a rack portion 36*a* of the slider 36. A means for changing the direction of motion is hence formed by the rack portion 36*a* and pinion portion 45*a*.

The slider 36 moves slidably between a retreated position in a state where the base 30 and tongue 47 are connected to each other as shown in FIG. 6 and FIG. 7, a cross-sectional view taken along line VII—VII of FIG. 6, and an advanced position in a state where the tongue 47 has been released from the base 30 as depicted in FIG. 8. Owing to this sliding movement of the slider 36, the actuator 45 is rotated about its shaft 45*b* by way of the rack-pinion mechanism. Incidentally, a push-out spring 39 is provided between a projection 37 of the slider 36 and a projection 38 of the casing 46.

The rest of the structure is the same as the corresponding structure in the first embodiment and its description is therefore omitted herein.

In the second embodiment, in the state of FIG. 6 in which the base 30 and tongue 47 are connected to each other, the actuator 45 is maintained at the first position by the base 30 by way of the slider 36, tongue 47 and latch piece 32. In the state of FIG. 8 in which the tongue 47 has been released from the base 30, the force of the push-out spring 39 is transmitted to the actuator 45 by way of the slider 36, rack portion 36*a* and pinion portion 45*a*, so that the actuator 45 is maintained at the second position. More specifically, in the tongue-released state, frictions are caused to occur by the spring force applied from the latch spring 34 to the latch piece 32 between the latch piece 32 and an acting edge 49 of the slider 36 and between the slider 39 and the inner wall of the arched top portion of the base 30 respectively. By the resultant force of the frictions and the spring force of the push-out spring 39, the actuator 45 is maintained at the second position.

In the second embodiment, the pinion portion 45*a* and rack portion 36*a* may be replaced by cams.

The above embodiments have each been described with reference to the ERB equipped with the actuator which triggers the belt-wearing warning switch. It should however be borne in mind that the present invention is not limited to such ERBs. The present invention can be applied equally to any buckles so long as they releasably receive their corresponding tongues and they are equipped with actuators adapted to act on peripheral devices.

Having now fully described the invention, it will be apparent to one of ordinary skill in the art that many changes and modifications can be made thereto without departing from the scope of the invention as set forth herein.

I claim:

1. A buckle comprising:

a tongue;

a base;

a latch means capable of selectively taking either a latching state, in which the tongue is connectable to the base, or a non-latching state in which the tongue is release from the base;

an operation means for bringing the latch means from the latching state to the non-latching state;

a casing defining at least a tongue-inserting opening and an operation-means operating opening; and an actuator means mounted within the casing for sensing whether or not the tongue is connected to the base and triggering a peripheral device when the tongue is connected to the base, said actuator means being capable of taking a first state while the tongue is connected to the base by the latch means in its latching state or a second state while the tongue is released from the base, a smaller part of said actuator means being exposed outside the casing in the first state than in the second state.

2. A buckle comprising:

a tongue;

base;

a latch means supported on the base and being capable of selectively taking either a latching state, in which the tongue is connectable to the base, or a non-latching state in which the tongue is released from the base;

an operation means for bringing the latch means from the latching state to the non-latching state;

a casing defining at least a tongue-inserting opening and an operation-means operating opening; and an actuator means mounted within the casing for sensing whether or not the tongue is connected to the base and triggering a peripheral device when the tongue is connected to the base, said actuator means being connected to the latch means and being capable of taking a first position in correspondence with the latching state of the latch means and a second position in correspondence with the non-latching state of the latch means, wherein essentially all of said actuator means is received within said casing then said actuator means is in the first position, and wherein a portion of said actuator means is exposed outside said casing when said actuator means is in the second position, said portion triggering the peripheral device.

3. The buckle as claimed in claim 1, wherein the actuator means is received, at the first state, completely within the casing.

4. The buckle as claimed in calim 2, further comprising a movable member displaceable between a holding position where the movable member holds the latch means in the non-latching state and a non-holding position where the movable member allows the latch means to be brought into the latching state.

5. The buckle as claimed in claim 4, wherein the actuator means is provided fixedly on the latch means.

6. The buckle as claimed in claim 4, further comprising a means for biasing the latch means toward the latching state.

7. The buckle as claimed in claim 4, further comprising a means for biasing the movable member toward the holding position.

8. A buckle comprising:

a tongue;

a base;

a latch means supported on the base and being capable of selectively taking either a latching state, in which the tongue is connectable to the base, or a non-latching state in which the tongue is released from the base;

an operation means for bringing the latch means from the latching state to the non-latching state;

a casing defining at least a tongue-inserting opening and an operation-means operating opening; and an actuator means mounted within the casing for sensing whether or not the tongue is connected to the base and triggering a peripheral device when the tongue is not connected to the base, said actuator means being capable of taking a first state upon insertion of the tongue into the base so as to allow the latch means to take the latching state or a second state upon ejection of the tongue from the base so as to hold the latch means in the non-latching state, wherein essentially all of said actuator means is received within said casing when said actuator means is in the first state, and wherein a portion of said actuator means is exposed outside said casing when said actuator means is in the second state, said portion of the actuator means triggering the peripheral device.

9. The buckel as claimed in claim 8, wherein the actuator means includes a movable member capable of taking a retreated position upon insertion of the tongue into the base or an advanced position, which is closer to the tongue-inserting opening, upon ejection of the tongue from the base, and an actuator capable of taking a first position corresponding to the retrated position of the movable member or a second position corresponding to the advanced position of the movable member, wherein essentially all of said actuator is received within said casing when said actuator is in the first position, and wherein a portion of said actuator is exposed outside said casing when said actuator is in the second position, said portion of the actuator triggering the peripheral device.

10. The buckle as claimed in claim 9, wherein the actuator is connected to the movable member via a means for changing the direction of motion.

11. The buckle as claimed in claim 10, wherein the means for changing the direction of motion is constructed of a rack portion formed on the movable member and a pinion portion provided with the actuator and maintained in meshing engagement with the rack portion.

* * * * *